US005259935A

United States Patent [19]

Davidson et al.

[11] Patent Number: 5,259,935

[45] Date of Patent: Nov. 9, 1993

[54] STAINLESS STEEL SURFACE PASSIVATION TREATMENT

[75] Inventors: Jeffrey Davidson, Millburn; Robert Sherman, New Providence, both of N.J.; Richard Paciej, Lansdale, Pa.; Takashi Sakanaka, Tsurugashima, Japan; Shigeki Hayashi, Sakai, Japan; Yoshiyuki Nakahara, Osaka, Japan

[73] Assignee: The BOC Group, Inc., New Providence, N.J.

[21] Appl. No.: 875,506

[22] Filed: Apr. 29, 1992

Related U.S. Application Data

[63] Continuation-in-part of Ser. No. 790,952, Nov. 12, 1991, Pat. No. 5,188,714, which is a continuation-in-part of Ser. No. 695,476, May 3, 1991, abandoned.

[51] Int. Cl.[5] ..... C25F 3/24

[52] U.S. Cl. ..... 204/129.1; 204/140; 148/280; 148/286; 148/606

[58] Field of Search ..... 204/129.1, 129.35, 140; 148/606, 280, 286

[56] References Cited

U.S. PATENT DOCUMENTS

| | | | |
|---|---|---|---|
| 2,257,668 | 9/1941 | Gottfried | 148/240 X |
| 3,247,086 | 4/1966 | Goldstein | 204/140 |
| 3,287,237 | 11/1966 | Wilton | 204/140 |
| 3,490,958 | 1/1970 | Robinson, Jr. | 148/606 |
| 4,033,274 | 7/1977 | Beese | 113/120 A |
| 4,772,337 | 9/1988 | Kesten | 204/129.1 X |
| 5,009,963 | 4/1991 | Ohmi et al. | 148/283 X |
| 5,167,735 | 12/1992 | Jurmann | 148/606 |

FOREIGN PATENT DOCUMENTS

| | | | |
|---|---|---|---|
| 0065712 | 5/1977 | Japan | 148/606 |

OTHER PUBLICATIONS

Tomari, et al. "Metal Surface Treatment for Semiconductor Equipment Oxygen Passivation Solid State Technology" Feb. 1991 pp. S1-S5.

Miayauchi et al. "Proceedings of the 31st Joint Lecture Meeting on Vacuum" p. 34.

Asami et al. "Changes in the Surface Compositions of Fe Cr Allovs Caused by Heating in a High Vacuum" Corrosion Science vol. 18.

Hultquist et al. "Highly Protective Films on Stainless Steels" Materials Science and Engineering vol. 42 1980 pp. 199-206.

Adams A Review of the Stainless Steel Surface J Vac Sci Technol. vol. A 1 (1) 1983 pp. 12-18.

*Primary Examiner*—Donald R. Valentine

*Attorney, Agent, or Firm*—David M. Rosenblum; Larry R. Cassett

[57] ABSTRACT

The present invention provides a method for surface passivating stainless steel articles against the effects of corrosive materials having activities anywhere from aqueous salt solutions to corrosive gases such as hydrogen chloride and silane. Additionally, after the treatment and exposure of the article to moisture, when the article is subsequently flushed with a dry gaseous fluid, the time that the article takes to exhibit an acceptable moisture outgassing rate is reduced over an untreated article. In accordance with the present invention, the surface to be passivated is flushed with a dry gaseous fluid, chemically non-reactive with the stainless steel and containing essentially no oxygen. During such flushing, the articles is baked and cooled. The baking is accomplished at a predetermined temperature and time (preferably between about 250.0° C. and about 500.0° C. for about 4.0 hours) to effect, within the oxide layer, a reduction in adsorbed moisture and hydroxide content and an increase in chromium content. The article is allowed to cool after the baking step. Such gaseous fluid can comprise argon having a moisture content of no greater than 10.0 ppb and an oxygen content of about 10 ppb. No improvement was seen in a sample in which nitrogen was used. When nitrogen shows no improvement, the article should be flushed with a rare gas during baking which additionally should contain 10 ppb nitrogen or less.

16 Claims, 7 Drawing Sheets

| | NO | CONDITION OF HEAT TREATMENT | | | | | | Cr/Fe ATOMIC RATIO | THICKNESS OF OXIDE FILM Å | CORROSION RESISTANCE |
|---|---|---|---|---|---|---|---|---|---|---|
| | | HEATING TEMPERA-TURE °C | HEATING TIME HOURS | INERT GAS | OXYGEN CONCENTRA-TION ppm | NITROGEN CONCENTRA-TION ppm | MOISTURE CONCENTRA-TION ppb | | | |
| EXAMPLE | 1 | 350 | 4 | Ar | 0.01 | 0.01 | 10 | 2.6 | 57 | 0 |
| | 2 | 400 | 4 | Ar | 0.01 | 0.01 | 10 | 2.8 | 60 | 0 |
| | 3 | 400 | 4 | Ar | 0.09 | 0.01 | 10 | 2.7 | 65 | 0 |
| | 4 | 400 | 4 | He | 0.09 | 0.01 | 10 | 2.7 | 63 | 0 |

FIG. 6

| NO | CONDITION OF HEAT TREATMENT | | | | | | Cr/Fe ATOMIC RATIO | THICKNESS OF OXIDE FILM Å | CORROSION RESISTANCE |
|---|---|---|---|---|---|---|---|---|---|
| | HEATING TEMPERA-TURE °C | HEATING TIME HOURS | INERT GAS | OXYGEN CONCENTRA-TION ppm | NITROGEN CONCENTRA-TION ppm | MOISTURE CONCENTRA-TION ppb | | | |
| 10 | 400 | 1 | Ar | 0.01 | 0.01 | 10 | 2.1 | 50 | X |
| 11 | NOT APPLIED | | | | | | 1.7 | 45 | X |
| 12 | 400 | 4 | $N_2$ | 0.01 | – | 10 | 1.9 | 55 | X |
| 13 | 400 | 4 | Ar | 0.5 | 0.01 | 10 | 1.8 | 63 | X |
| 14 | 400 | 4 | Ar | 1 | 0.01 | 10 | 1.4 | 70 | X |
| 15 | 400 | 4 | Ar | 0.01 | 0.01 | 100 | 2.3 | 63 | X |
| 16 | 500 | 4 | Ar | 0.09 | 0.01 | 10 | 3.0 | 85 | X |
| 17 | 200 | 4 | He | 0.09 | 0.01 | 10 | 2.0 | 45 | X |
| 18 | 400 | 4 | $N_2$ | 0.5 | – | 10 | 1.2 | 75 | X |
| 19 | 400 | 4 | Ar | 0.01 | 0.5 | 10 | 1.9 | 60 | X |

COMPARATIVE EXAMPLE

FIG. 7

| | NO | PROCESS OF HEAT TREATMENT | ATAOMPHERIC GAS | Cr/Fe ATOMIC RATIO | THICKNESS OF OXIDE FILM Å | CORROSION RESISTANCE |
|---|---|---|---|---|---|---|
| EXAMPLE | 20 | FIG. 9 | $Ar \rightarrow N_2$ | 2.6 | 63 | 0 |
| | 21 | FIG. 10 | $N_2 \rightarrow Ar \rightarrow N_2$ | 2.0 | 55 | X |
| | 22 | FIG. 11 | $N_2 \rightarrow Ar \rightarrow N_2$ | 2.2 | 57 | X |
| | 23 | FIG. 12 | $N_2 \rightarrow Ar \rightarrow N_2$ | 1.9 | 53 | X |

FIG. 8

STAINLESS STEEL SURFACE PASSIVATION TREATMENT

RELATED APPLICATIONS

This is a continuation-in-part of Ser. No. 790 952 filed Nov. 12, 1991, now U.S. Pat. No. 5,188,714 which is in turn a continuation-in-part of Ser. No. 695,476, filed May 3, 1991 now abandoned.

BACKGROUND OF THE INVENTION

The present invention relates to a treatment for stainless steel to passivate a surface of the steel by removing adsorbed and absorbed moisture and by enhancing corrosion resistance to corrosive materials. More particularly, the present invention relates to such a surface passivation treatment wherein the surface to be treated is flushed with a dry chemically non-reactive gaseous fluid containing essentially no oxygen while the steel is baked for a predetermined time and temperature and thereafter cooled.

In ultra-high purity gas distribution systems that contain piping, valves, chambers and etc., it is important that the system itself does not contaminate the gas to be distributed by adding contaminants such as moisture and particulate matter to the gas. With respect to moisture, ultra-high purity gas distribution systems are generally flushed with an inert gas prior to use in order to outgas moisture and therefore prevent moisture contamination during subsequent operation of the system. In order to prevent possible particulate contamination due to corrosion, the components of ultra-high purity gas distribution systems are commonly fabricated from stainless steel. In the prior art it is known that stainless steel is resistant to corrosion because it possesses a surface enriched in chromium oxide. Generally speaking, the higher the content of chromium in stainless steel, the more resistant the steel is to the effects of corrosion. However, when corrosive gases such as hydrogen chloride or silane are to be distributed, even stainless steel components can react with the gasses to add unacceptable amounts of contaminants to the gas to be distributed.

The corrosion of concern in the prior art concerns resistance to chloride attack by neutral pH, aqueous salt solutions rather than to corrosive gases. It is known that corrosion resistance to such chloride attack at the surface of a polished stainless steel component can be enhanced by baking the component in a high vacuum furnace to enrich the chromium oxide content of the surface of the component. For instance, Asami et al., "Changes in the Surface Compositions of Fe-Cr Alloys Caused by Heating in a High Vacuum", Corrosion Science, Vol. 18, 1978, pp. 125–137, discloses that when polished stainless steel is heated in a vacuum at a temperature of about 380° C., enhanced chromium surface enrichment can be observed by x-ray photo-electron spectrographic techniques. Hultquist et al., "High Protective Films on Stainless Steels", Material Science and Engineering, Vol 42, 1980, pp. 199–206, discloses a method for enhancing the corrosion resistance of stainless steel in which the steel is baked at a temperature range of between about 277.0° C. to about 477° C. in a high vacuum furnace. Furthermore, Adams, "A Review of the Stainless Steel Surface", Journal of Vacuum Science Technology, Vol A1(1), 1983— pp. 12–18, discusses heating type 316 stainless steel in a temperature range of between about 250° C. to about 500° C. in partial pressures of oxygen of $5\times10^{-7}$ Torr to about $10^{-5}$ Torr to produce chromium enrichment and enhanced corrosion resistance.

A central disadvantage of such prior art techniques, as discussed above, is that they all involve the use of high vacuum equipment which adds to the expense and complexity of the treatment. In any event, the prior art has not applied techniques that involve baking polished stainless steel under conditions of vacuum or low partial pressures of oxygen to chemically passivate the surface of stainless steel against corrosive gases such as hydrogen chloride gas and silane.

As will be discussed, the present invention provides a Passivation treatment for stainless steel that is effective to provide resistance to surface chemical reactions between stainless steel and corrosive materials without the use of expensive vacuum equipment while reducing the degree to which the stainless steel will outgas moisture. An important added benefit is that even after the stainless steel has been exposed to moisture the treatment, the subsequent flushing time involved in reducing the moisture outgassing of the steel to very low levels is also reduced.

SUMMARY OF THE INVENTION

The present invention provides a surface passivation treatment for stainless steel. The method involved in the present invention has applicability to the treatment of components of ultra-high purity gas distribution systems to prevent such systems from introducing contaminants into the gas to be distributed when the gas is a corrosive gas such as hydrogen chloride or silane.

It has been found by the inventors herein that stainless steel adsorbs moisture at its surface and also absorbs moisture by forming metallic-hydroxide compounds. Such moisture will outgas from a stainless steel component of an ultra-high purity gas distribution system to contaminate the gas to be distributed. Also, such moisture plays a part in the introduction of other impurities. For instance, when the component is exposed to hydrogen chloride gas, a hydrochloric acid solution can be formed when moisture reacts with the gas. The chloride ions will attack iron oxide and defects in the chromium oxide to form iron chloride compounds which in turn form a source of particulate contamination. Since iron chloride compounds are soluble in water, a fresh surface is provided that is susceptible to further attack. Silane also reacts with the moisture to form particles of silicon dioxide and hydrogen contaminants.

It also has been found by the inventors herein that the hydrogen chloride gas will react directly with iron oxide present at the surface of the steel to produce particulate contamination from iron chloride and water formed as a result of such reaction. In addition to the foregoing, even ultra-high pure samples of silane may contain chlorosilane as an impurity that can react with moisture to form hydrochloric acid. Hydrochloric acid formed by this mechanism can act in the same manner as that produced by hydrogen chloride gas.

In accordance with the present invention, a stainless steel article, such as a component of an ultra-high purity gas distribution system, is surface passivated by baking the article at a predetermined temperature and for a predetermined time period and cooling the article. During the baking and the cooling of the article, the surface of the article to be passivated is subjected to an atmosphere comprising a gaseous fluid by being flushed with the gaseous fluid. The gaseous fluid is chemically non-reactive with the stainless steel and is substantially free of moisture and oxygen at room temperature. As is known in the art, the surface of any stainless steel article is formed by a surface oxide layer containing chromium oxide, chromium, hydroxide in the form of metal hydroxides, iron oxide and adsorbed moisture. In the present invention, the article is baked at a predetermined temperature and for a predetermined time period such that the surface to be passivated becomes passivated. As used herein and in the claims, "passivated" or "passivation" can generally be regarded an increase in corrosion resistance due to an increase in the chromium content and a reduction in adsorbed moisture and hydroxide content in the surface oxide layer, as well as the reductions in adsorbed moisture and hydroxide content in and of themselves. Moreover, "dry", as that term is used herein and in the claims means containing less than about 10.0 ppb $H_2O$. During the cooling of the article, the surface to be passivated is subjected to an environment comprising a cooling gas by flushing the surface to be passivated with the cooling gas. The cooling gas is substantially free of oxygen and moisture at room temperature. It is to be noted that the gaseous fluid and the cooling gas can comprise the same gas.

It has been found that exposure of certain samples of stainless steel article to nitrogen gas during baking will not effect an increase in corrosion resistance. Such samples require exposure to a rare gas atmosphere during the baking of the article. In accordance with this, the surface to be passivated is subjected to an atmosphere comprising a rare gas, substantially free of moisture, oxygen, and nitrogen at room temperature, by flushing the surface to be passivated with the rare gas. The term, "rare gas" as used herein and in the claims includes all group VIII gases of the periodic table including argon.

Before an ultra high purity gas distribution system is put into service, it is flushed with a dry, inert gas (which does not have to be the gaseous fluid used in effectuating the method of the present invention) to outgas moisture from the components making up the system. The reduction of adsorbed moisture and hydroxide content in the surface oxide layers of such components in accordance with the present invention will shorten this flush time. This is advantageous in and of itself in that it allows an ultra-high purity gas distribution system incorporating components treated in accordance with the present invention to be brought into service much faster than one incorporating untreated components.

Additionally, as mentioned above, the surface oxide layer of the article has an increase in chromium content to resist corrosion not only by chloride attack arising from neutral pH salt solutions considered under the prior art, but also, through acidic solutions such as hydrochloric acid and through direct attack by hydrogen chloride gas. The increased chromium content contemplated by the present invention is not accompanied by an increase in the thickness of the oxide layer (within experimental error and variation of oxide thickness from article to article) due to an increase in chromium oxide and iron oxide because the gaseous fluid contains essentially no oxygen. It has been found by the inventors herein that if oxygen is present in even a slight concentration having an order of magnitude of about 1.0 ppm, that the surface oxide layer thickness will increase and contain more chromium oxide and iron oxide. As may be appreciated from what has been discussed above, an increase in iron oxide will increase the possibility of contamination.

It is to be noted here that halides such as HI, HBr, HF, and HCl will all react with iron oxide in the manner of hydrogen chloride gas. As such, the present invention has application to providing passivation against such halides or any other material that would react with moisture to form halide containing acidic solutions. Moreover, in addition to silane, the present invention has application to passivate a treated surface against any hydride that will react with water.

In addition to the foregoing, since the baking process of the present invention does not normally involve the use of high vacuum, an entire ultra-high purity gas distribution system can be treated by connecting it to a source of dry inert gas such as argon passed through an adsorber while being heated by heating tape wrapped around components of the the system. Alternatively, individual components can be treated in for instance, a relatively inexpensive pipe furnace and then sealed in a clean room for shipment to a site of eventual installation.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

Figure 9:
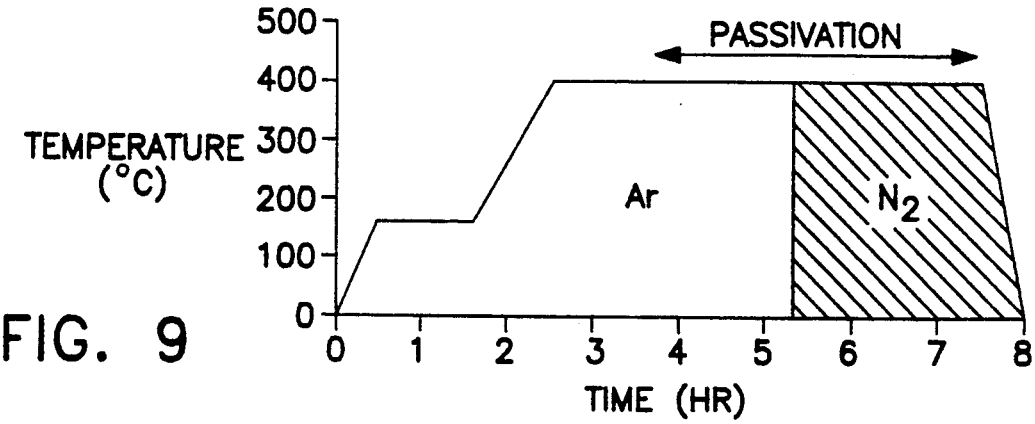
Figure 10:
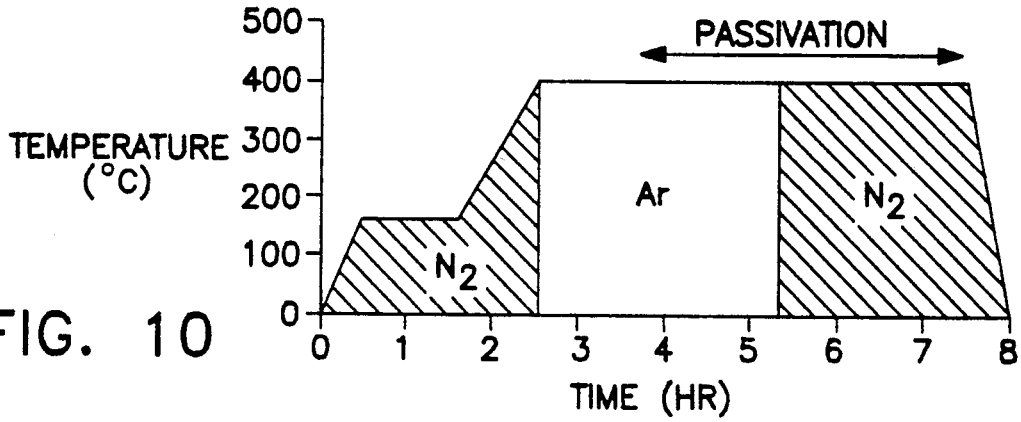
Figure 11:
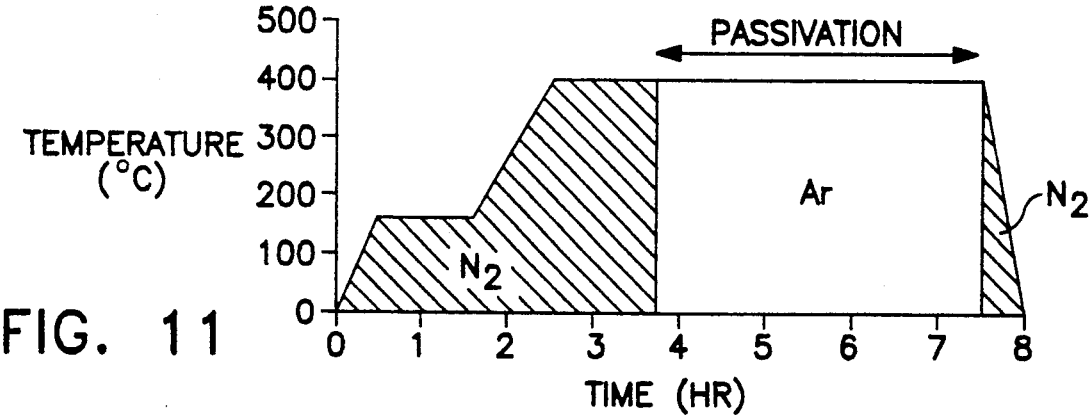
Figure 12:
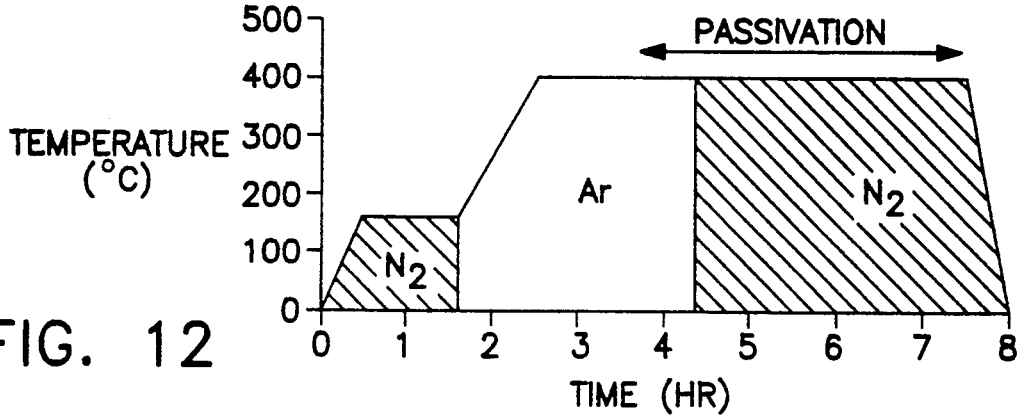

In the graphs of FIGS. 2 through 5, the ordinate is in counts and the abscissa is the binding energy in electron volts;

FIG. 6 is a table of test results combined;

FIG. 7 is a table of comparative test results;

FIG. 8 is a table of the test results obtained when nitrogen is used in a passivation treatment in accordance with the present invention;

FIG. 9 is a graph of a temperature time profile and gas utilized in accordance with a passivation treatment designated as Example No. 1 of FIG. 8;

FIG. 10 is a graph of a temperature time profile and gas utilized in accordance with a passivation treatment designated as Example No. 2 of FIG. 8;

FIG. 11 is a graph of a temperature time profile and gas utilized in accordance with a passivation treatment designated as Example No. 3 of FIG. 8; and FIG. 12 is a graph of a temperature time profile and gas utilized in accordance with a Passivation treatment designated as Example No. 4 of FIG. 8.

DETAILED DESCRIPTION

Figure 1:
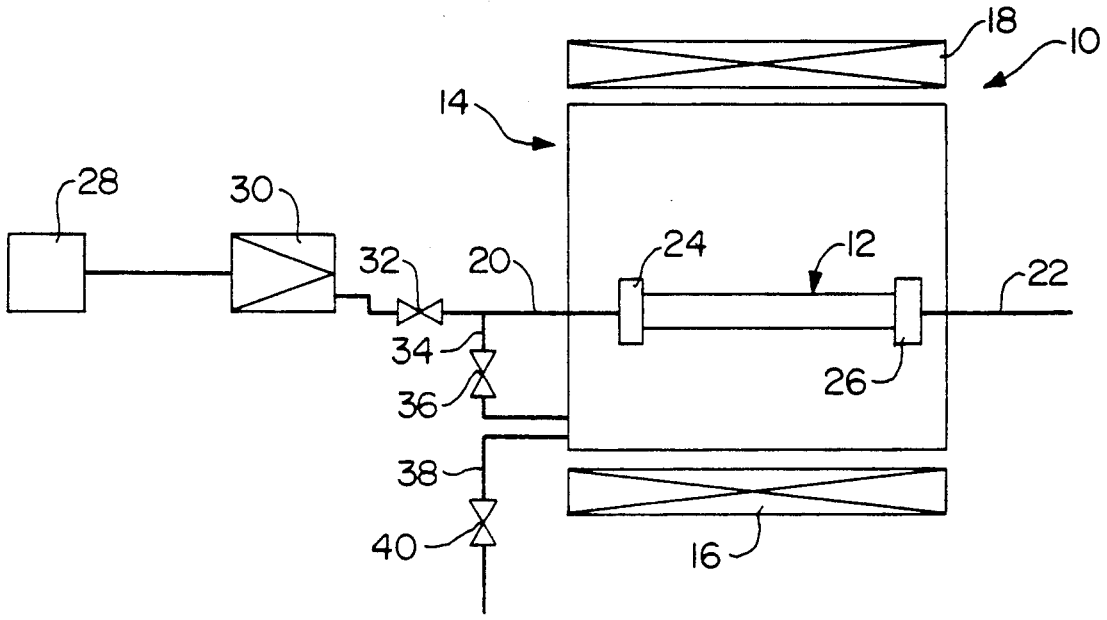
FIG. 1 is a schematic view of an apparatus used in carrying out the method of the present invention.

With reference to FIG. 1, a tube furnace 10 is illustrated for baking a pipe 12 in accordance with the method of the present invention. Tube furnace 10 is provided with a chamber 14 surrounded by heating coils 16 and 18. A pair of inlet and exhaust lines 20 and 22 communicate with the interior of chamber 14 and are provided with a pair of couplings 24 and 26 connected to pipe 12 at opposite ends thereof. A source of a chemically non-reactive gaseous fluid 28 (that is a gaseous fluid that will not react with stainless steel, preferably a tank of argon, but also any other inert gas, mixture of inert gases, gases such as nitrogen or mixtures thereof which with respect to stainless steel are non-chemically reactive) is connected to a purifier 30 capable of reducing the moisture of the gaseous fluid down to about 10.0 ppb and below. Purifier 30 is connected to inlet line 20 and is provided with a proportional valve 32. A by-pass line 34 is also connected to inlet line 20. By-pass line 34 communicates with the interior of chamber 14 and is provided with an in line proportional valve 36. Lastly, a vent line 38 having an in line cut-off valve 40 also communicates with the interior of chamber 14.

The method of the present invention is most effectively practiced on a stainless steel article that has been polished to reduce the surface roughness of the article. Many standard metal forms such as pipes are electropolished by the fabricator and therefore can be obtained with a reduced surface roughness. The stainless steel pipes that were used in the examples that follow were electropolished to have an average surface roughness of about 0.127 microns as measured by a profilometer.

In accordance with the method of the present invention, pipe 12 having the requisite surface roughness is located into chamber 14 and is connected to couplings 24 and 26. Coils 16 and 18 are energized to heat chamber 14 and thus, pipe 12. At the same time valves 32, 36 and 40 are open allowing the dry gaseous fluid to continually flush the interior of pipe 12. The continual flushing of the exterior of pipe 12 prevents discoloration of the outer surface of pipe 12 that might otherwise be caused by oxidation. It is understood, however, that this is optional and if surface discoloration is not at issue, this step of the method can be completely dispensed with by keeping valve 36 closed while opening valve 40 to admit air into chamber 14. It is important to note that the flow of gaseous fluid, passing through the interior of pipe 12, must be at a sufficient flow rate and velocity to carry away any moisture being baked out of pipe 12. This becomes especially important in the case of components such as valves and vacuum pumps in which if the flow is not sufficient, dead spaces can form that will prevent the component from being entirely passivated.

After completion of the baking, heating coils 16 and 18 are turned off and pipe 12 is allowed to cool to ambient. During the cooling time, it is important that the gaseous fluid continually flush the interior to pipe 12. After completion of the cool down, valve 32 is closed and pipe 12 is then removed from furnace 10.

The process, described above, is preferably conducted at an elevated temperature. It has been found that the beneficial corrosion resistant effects of the present invention tend to fall off at baking temperatures above about 500.0° C. and below about 250.0° C. Additionally, the beneficial results tend to also fall off at baking times of about 2.0 hours and below. In this regard, over the temperature range discussed above, the present invention produces the most beneficial results at baking times of about 4.0 hours or greater. It should be noted that increasing the baking time over four hours produces no increased benefit. Additionally, baking temperatures preferably fall in a range of between about 275.0° C. to about 450.0° C., but most preferably in a range of between about 300.0° C. and about 375.0° C. The best results have been obtained at a baking temperature of about 320.0° C. and a baking time of about 4.0 hours.

As an example, an electropolished tube fabricated from 316L stainless steel and having a diameter of about 9.53 mm. and a surface roughness of less than about 0.127 microns was baked in the manner outlined above for a period of about 4.0 hours and at a baking temperature of about 415.0° C. The gaseous fluid used was argon containing approximately 10 ppb oxygen purified by purifier 30 to a moisture level of about 10 ppb (Dew Point less than about −100.0° C.) The flow rate of argon flushing the interior of the pipe was approximately 20.0 liters per minute. During the baking of the pipe the flow rate of the argon flushing the exterior of the pipe was approximately 30.0 liters per minute. During the heat up time to the baking temperature and after the baking time, argon flushed the exterior of the pipe at a flow rate of about 20.0 liters per minute. The flow rates of argon were obtained by appropriate adjustment of valves 32 and 36 and 40.

A tube treated in the manner of the example was exposed to an atmosphere maintained at about 21.0° C. and at a humidity of about 60.0% for about 24.0 hours. Following this, purified nitrogen with a moisture content of less than about 1.0 ppb was Passed through the tube at a flow rate of about 0.45 liters per minute. The moisture content in the nitrogen leaving the pipe was then monitored by a cryogenic dew point meter and readings were taken until the moisture content reached about 1.0 ppb. It was found that in the treated specimen it took about 166.0 minutes to reach this level of moisture content as compared with 221.0 minutes for an untreated specimen. It is to be noted that a similarly treated specimen baked at a baking temperature of about 320.0 degrees took about 141.0 minutes to reach the moisture content of about 1.0 ppb. The lower subsequent flushing times of the treated pipes indicate that the treated pipes have less adsorbed moisture and hydroxide content. Moreover, if such treated pipes formed components of an ultra-high purity gas distribution system, their lower subsequent flushing times would be advantageous to users of such a system.

A tube treated in accordance with the example baked at the 415° C. temperature was subjected at its treated inner surface to X-Ray Photo Electron Spectroscopy, known in the art as "XPS". This technique showed an untreated pipe specimen to have a ratio of chromium to iron of about 2.0 and a ratio of metallic oxides to hydroxides of about 0.4. In the treated pipe specimen, the foregoing ratios increased to 2.6 and 2.8, respectively. Additionally, the oxide thickness was found to be about the same in both the treated and untreated specimens. As such, the treated specimen showed an enrichment of chromium in the oxide layer without an increase in chromium oxide and iron oxide layer thicknesses. Thus, an oxygen content of 10 ppb is essentially no oxygen because it is not enough oxygen to produce a measurable increase in chromium oxide and importantly iron oxide. In this regard, when a tube was treated in accordance with the example baked at 415° C. except that nitrogen having a content of 1 ppm of oxygen was used in place of the argon, the oxide layer was found to have an increase in thickness of roughly 1.4 times the tube treated with argon containing 10 ppb of oxygen. Such tube was also found to contain more iron oxide than the sample treated in accordance with the present invention. It should be mentioned that the allowable oxygen concentration is preferably less than 100 ppb, more preferably less than 50 ppb and ideally, 10 ppb or less.

Figure 2:
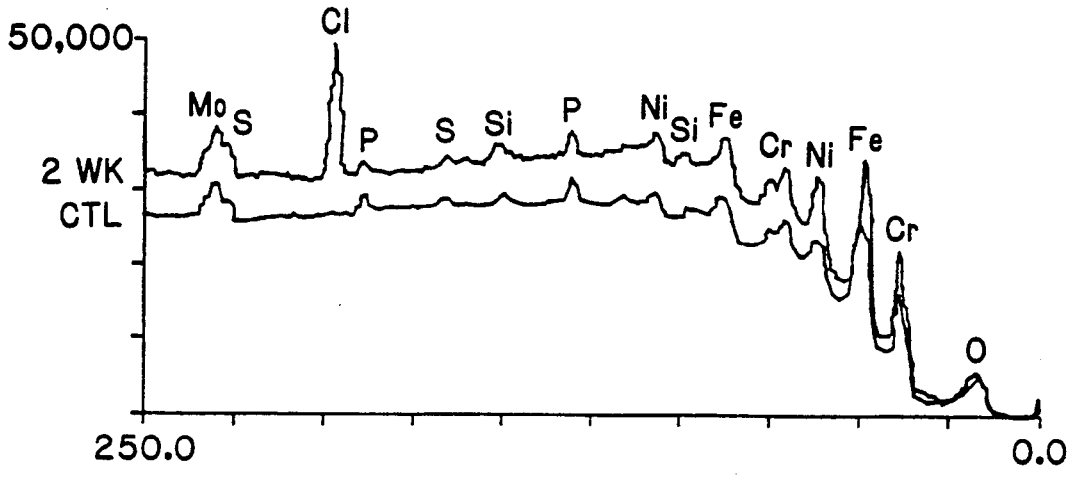
FIG. 2 is a graph produced by X-Ray Photo Electron Spectroscopy of the surface constituents of an electropolished stainless steel tube of approximately 9.53 mm. in diameter when subjected over a two week time period to dry hydrogen chloride gas.
Figure 3:
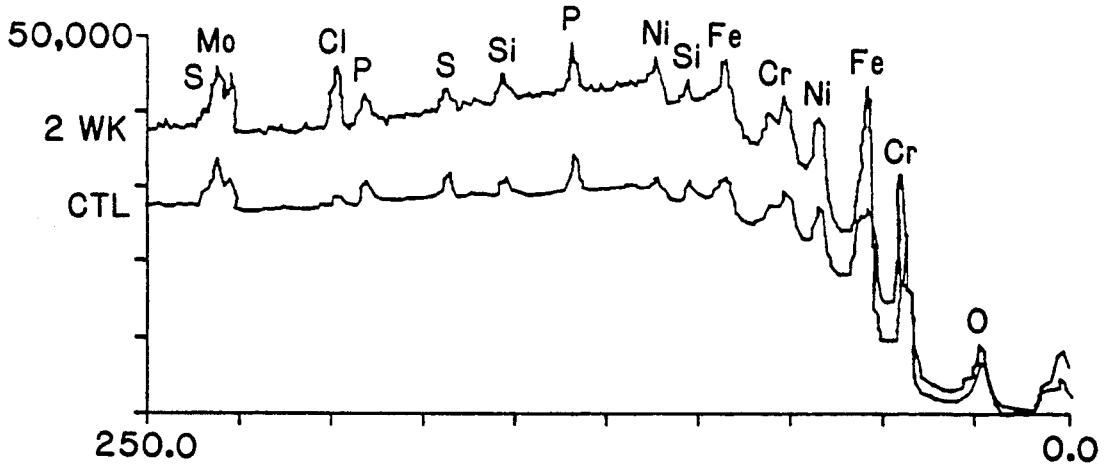
FIG. 3 is a graph produced by X-Ray Photo Electron Spectroscopy of the surface constituents of an electropolished stainless steel tube of approximately 9.53 mm. in diameter after treatment in accordance with the method of the present invention and when subjected over a two week time period to dry hydrogen chloride gas.

With reference to FIGS. 2 and 3, a specimen treated in the manner of the sample baked at about 415° C. was found to have superior resistance to the possible effects of exposure to dry hydrogen chloride gas. FIGS. 2 and 3 are charts obtained by XPS techniques of the surface compositions of an untreated tube specimen and a tube specimen treated in accordance with the example after exposure to dry hydrogen chloride gas for a two week period. The surface composition of a control specimen (CTL) was superimposed on both charts. If FIGS. 2 and 3 are compared, it can be seen that the untreated specimen has a greater chlorine count. This indicates an increased degree of reaction of the gas with the untreated specimen.

Figure 4:
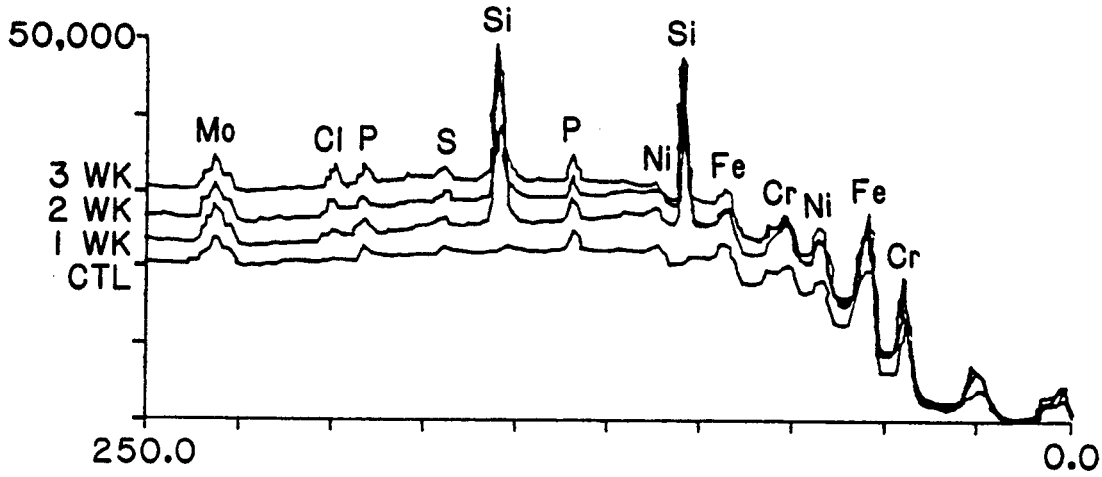
FIG. 4 is a graph produced by X-Ray Photo Electron Spectroscopy of the surface constituents of an electropolished stainless steel tube of approximately 9.53 mm. in diameter when subjected over a three week time period to silane.
Figure 5:
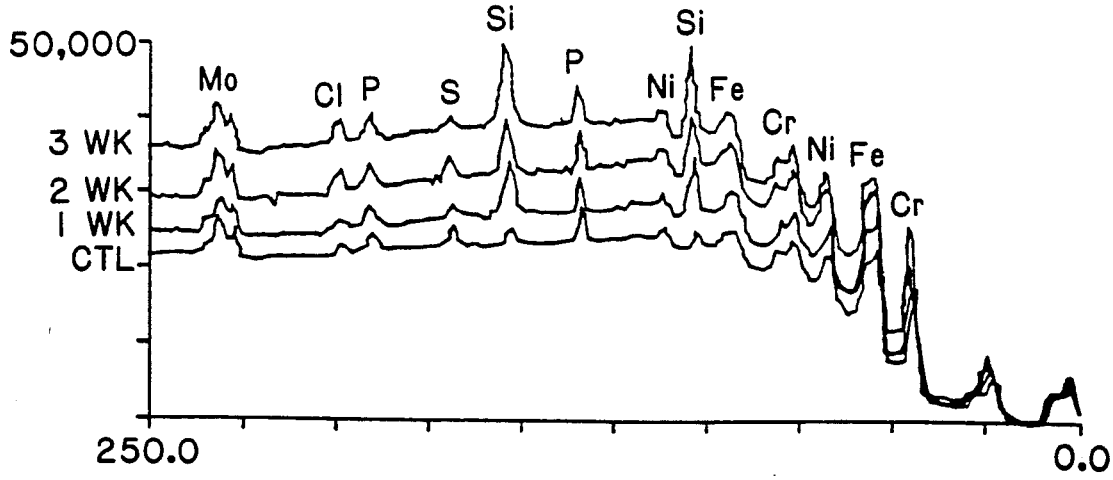
FIG. 5 is a graph produced by X-Ray Photo Electron Spectroscopy of the surface constituents of an electropolished stainless steel tube of approximately 9.53 mm. in diameter after treatment in accordance with the method of the present invention and when subjected over a three week time period to silane.

With reference to FIGS. 4 and 5, a specimen treated in the manner of the sample baked at about 415° C. was also found to have a lower activity of reaction to silane. FIGS. 4 and 5 are charts obtained by XPS techniques of the surface compositions of an untreated tube specimen and a tube specimen treated in accordance with the example after exposure to silane over a three week period. The surface composition of a control specimen (CTL) was superimposed on both charts. If FIGS. 4 and 5 are compared, a larger spike exists for the silicon count of the untreated specimen indicating a greater reaction with the silane to form silicon dioxide.

As a general proposition, the results discussed above will have use in a wide variety of applications. However, it has been found that a sample of stainless steel tubing fabricated from SUS316L stainless steel pipe having an outside diameter of about 9.53 mm, an inside diameter of about 7.53 mm and a length of about 2 m, had an increased corrosion resistance when treated in the presence of a rare gas, such as argon, helium, and etc., but not when treated in the presence of nitrogen. Simply stated, when a sample is found that will not yield a desired increase in corrosion resistance because it is exposed to nitrogen during baking, nitrogen should not be used during baking. However, such treatment excludes nitrogen during the baking and not during the cooling. During cooling nitrogen can in fact be used with a savings of the expense that would otherwise be occasioned had argon been used throughout the passivation treatment. This can be effected by a modification to the apparatus illustrated in FIG. 1 by adding a piping tee before purifier 30, adding valves to the legs of the piping tee, and connecting a source of nitrogen to one of the valves and a tank of the rare gas to the other of the valves.

Experiments Performed on this sample are summarized in FIGS. 6, 7, and 8. In performing the experiments the surface of the sample was first subjected to an electrolytic polishing treatment by anodic dissolution using an aqueous solution of $H_2SO_4$-$H_3PO_4$. The preferred resulting surface roughness was between about 0.1 μm to about 1.0 μm. Thereafter, the pipe was flushed with argon, nitrogen, or helium at flow rates given for the previous examples.

It was found from the experiments that the rare gas should contain impurities in a concentration as low as possible, not only for moisture and oxygen, as explained above, but also for nitrogen. In this regard, argon gas can be used having a moisture concentration of not more than 10.0 ppb and an oxygen concentration of less than 1 ppm, preferably less than 100 ppb, more preferably less than 50 ppb and ideally, 10 ppb or less. Furthermore, the nitrogen concentration should be not more than 10 ppb. A moisture concentration exceeding 10 ppm will reduce corrosion resistance. It has also been found that the treatment temperature will lie in a preferred range of about 350° C. and about 425° C. A less preferred heating range is between 250° C. and about 450° C. A heating time of not less than about 2 hours is preferred; and a heating time of about 4 hours is particularly preferred.

With reference to FIG. 6, Example Nos. 1, 2, 3, and 4 showed a passivation treatment in accordance with the present invention using argon and helium. The treatment yielded outstanding corrosion resistances indicated by the latter "O" in the second to the last column of the table.

The following tests were conducted in Examples 1–4 of FIG. 6, in order: an XPS analysis to determine chromium to iron ratio, oxide film thickness, and corrosion resistance. The corrosion resistance test consisted of charging the pipe, after treatment, with hydrogen chloride gas and leaving it for a period of about 10 days at room temperature. After the ten day period, the surface of the pipe was observed to determine the quality of corrosion resistance. Such observation was carried out by using a scanning electron microscope. A comparison between before and after micrographs of the pipe surface that showed minimum difference was taken as indicative of a favorable corrosion resistance. A sample that showed increased pitting was taken as an sample that showed poor corrosion resistance. Although not illustrated, for the samples of FIG. 6, an almost equivalent corrosion resistance was exhibited to an atmosphere containing moisture and chlorine gas and also to a silane atmosphere.

FIG. 7 illustrates comparative examples in which the corrosion resistance was poor as compared with Examples 1–4 in FIG. 6 as indicated by the letter "X". In FIG. 7, the tests performed were the same as performed for the samples of FIG. 6.

With respect to comparative Example No. 10, the heating time was 1 hour and the chromium to iron ratio was 2.1, lower than that of samples No. 1 and No. 3 of FIG. 6.

In comparative example No. 11, while the pipe was electrolytically polished, it was not treated in accordance with the present invention. The end result was that such pipe exhibited poor corrosion resistance. In Comparative Example No. 12 a treatment in accordance with the present invention was carried out using nitrogen gas as the flushing gas. As a result, corrosion resistance is poor.

Comparative Examples No. 13 and 14 illustrate a treatment in which the oxygen concentration is higher than that used in the Present invention. In both of these examples the corrosion resistance was found to be poor, even though the thickness of the oxide film was thicker than those of other embodiments. Comparative Example No. 15 illustrates a treatment in which moisture concentration exceeds the range of the present invention. In this example the chromium to iron ratio is high, yet corrosion resistance is poor.

In comparative Example No. 16 baking temperature exceeded the range of the present invention. As can be seen, the chromium to iron ratio is the highest of all the samples, the oxide film is the thickest, but the corrosion resistance is found to be substandard.

Comparative Example No. 17 illustrates the results of a heating temperature lower than the range of the present invention. The corrosion resistance of the sample was observed to be poor.

In comparative Example 18, nitrogen was used and the oxygen concentration was allowed to exceed the range of the present invention. The result was poor corrosion resistance. Comparative example 19 has the moisture concentration and the oxygen concentration controlled to be within the ranges of the present invention, but the nitrogen concentration exceeded the range of the present invention. As a result, corrosion resistance was found to be poor.

With reference to FIG. 8, the pipe of Example No. 20 was treated according to a temperature time profile shown in FIG. 9. After approximately 3½ hours of heat treatment at about 415° C., scarcely any change shown in surface condition could be observed, even after exposure of the sample to hydrogen chloride gas. This case is advantageous from an economic standpoint, in that the cooling stage can be performed using nitrogen gas. It should be mentioned here that the sample was also preheated while being flushed with argon at a temperature of about 150° C. and for a time period of about one hour thirty minutes. Such a preheating stage of the process can in fact be in a temperature range from between about 100° C. and about 150° C. and a time range of between about 30 minutes and about one hour, thirty minutes. Examples No. 21 and 22 are treatments having temperature time profiles of FIGS. 10 and 11, respectively. These two samples showed poor corrosion resistance. Example 23 is a treatment having a temperature time profile of FIG. 10. This sample was found not to have any observable corrosion resistance.

While a preferred embodiment to the present invention has been shown and described, it will be readily apparent to those skilled in the art, that changes and additions may be made without departing from the spirit and scope of the present invention.

We claim:

1. A method of surface passivating an article fabricated from stainless steel at a surface to be passivated, said method comprising:

subjecting the surface to be passivated to an atmosphere comprising a rare gas, chemically non-reactive with the stainless steel and substantially free of moisture, nitrogen and oxygen at room temperature, by flushing the surface to be passivated with the rare gas;

during the flushing of the surface to be passivated, baking the article at a temperature in a temperature range of between about 250° C. and about 500° C., and for a time period of greater than about 2 hours such that the surface to be passivated becomes passivated;

cooling the article; and during the cooling of the article, subjecting the surface to be passivated to an environment comprising a cooling gas, substantially free of oxygen and moisture at room temperature, by flushing the surface to be passivated with the cooling gas.

2. The method of claim 1, further comprising electropolishing the article at the surface to be passivated.

3. The method of claim 1, wherein:

the rare gas comprises argon; and the moisture and the oxygen are each present in the argon gas at a concentration of no greater than 10 ppb.

4. The method of claim 1, wherein the temperature range is between about 275° C. to about 450° C.

5. The method of claim 1, wherein the temperature range is between about 300° C. to about 375° C.

6. The method of claims 4 or 5, wherein the time period is not less than about 4.0 hours.

7. The method of claim 6, wherein the rare gas is argon having a moisture content and an oxygen content, each of no greater than about 10.0 ppb.

8. The method of claim 7, further comprising electropolishing the article at the surface to be passivated.

9. The method of claim 1, wherein the article is baked at a temperature range of between about 250° C. and about 450° C.

10. The method of claim 1, wherein the cooling gas comprises the rare gas.

11. The method of claim 1, wherein prior to baking the article, the surface to be passivated is subjected to a treatment of electrolytic polishing.

12. The method of claim 1, further comprising, prior to baking the article and while subjecting the surface to be passivated with the atmosphere of the rare gas, preliminarily heating the article at a temperature range of between about 100° C. and about 150° C. for a time period in a range of between about thirty minutes and about one hour, thirty minutes.

13. The method of claim 1 wherein the time period is not greater than about 4 hours.

14. The method of claim 1, wherein the moisture, oxygen, and nitrogen are each present in the rare gas at a concentration of no greater than 10 ppb.

15. The method of claim 1, wherein the rare gas comprises argon.

16. The method of claim 1 wherein the temperature range is between about 250° C. and 450° C.

* * * * *